United States Patent [19]

Felton, Jr.

[11] 4,033,886

[45] July 5, 1977

[54] RECYCLEABLE METALWORKING LIQUID

[75] Inventor: George F. Felton, Jr., Chadds Ford, Pa.

[73] Assignee: Suntech, Inc., St. Davids, Pa.

[22] Filed: Nov. 11, 1975

[21] Appl. No.: 630,823

Related U.S. Application Data

[63] Continuation-in-part of Ser. No. 545,845, Jan. 31, 1975, abandoned.

[52] U.S. Cl. ..... 252/34.7; 72/42; 252/49.3; 252/49.5

[51] Int. Cl.[2] ..... C10M 1/32

[58] Field of Search ..... 252/34.7, 49.3, 49.5; 72/42

[56] References Cited

UNITED STATES PATENTS

| | | | |
|---|---|---|---|
| 3,374,171 | 3/1968 | Davis | 252/34.7 |
| 3,429,909 | 2/1969 | Schuster | 252/49.5 X |
| 3,501,404 | 3/1970 | Klaiber et al. | 252/49.5 |
| 3,769,214 | 10/1973 | Davis | 252/34.7 |
| 3,791,974 | 2/1974 | Borchert | 252/49.5 |
| 3,980,571 | 9/1976 | Marx | 252/49.3 X |
| 3,983,044 | 9/1976 | Felton | 252/49.3 X |

*Primary Examiner*—Delbert E. Gantz
*Assistant Examiner*—Andrew H. Metz
*Attorney, Agent, or Firm*—Donald R. Johnson; J. Edward Hess; Anthony Potts, Jr.

[57] ABSTRACT

A metalworking liquid having utility as a recycleable general purpose cutting and grinding coolant contains a major amount of aqueous solution of a block copolymer of ethylene oxide and propylene oxide and having a molecular weight of about 1800–2900, and an amount of both an alkanolamine cinnamate and a boron amine complex effective to inhibit corrosion. Also the liquid generally contains a germicide, an antifoaming agent and a pH control agent. At an elevated temperature said liquid undergoes a phase separation in which most of the foregoing materials do not remain in the contaminated water which then can be discarded. The remaining mixture can be diluted with clean water and reused.

23 Claims, No Drawings

RECYCLEABLE METALWORKING LIQUID

CROSS REFERENCE TO RELATED APPLICATION

This application is a continuation-in-part of U.S. patent application Ser. No. 545,845, filed Jan. 31, 1975 and now abandoned.

BACKGROUND OF THE INVENTION

This invention relates to an aqueous based liquid having utility in metal working. The liquid can serve as a general purpose cutting liquid. It also can serve as a coolant. The metal working liquid of this invention performs two principal functions; (1) reduces the friction between moving metal surfaces in contact with each other, such as the chip and the toolface, for example, and (2) removes the heat generated during the time the metal is worked. In addition, the liquid also prevents chip build-up on the cutting tool, washes away metal chips as they are formed and also provides some degree of rust protection. In grinding it prevents the clogging of a grindng wheel by washing away paritcles of metal on the wheel itself as well as keeping the wheel from over-heating.

The liquid of the invention is well sited for high speed operations such as grinding and turning where during the machining operations the load is moderate to relatively light, and cooling and finish are of paramount importance.

U.S. Pat. No. 3,501,404 discloses an aqueous emulsion having utility as a lubricant for metal working. This emulsion contains an emulsifer and an olefin polymer having a molecular weight in the range of about 1500 to 25,000. The olefin polymer can be a block copolymer formed by reacting ethylene oxide with polyethylene.

U.S. Pat. No. 3,220,893 discloses a water-soluble polyalkylene glycol containing both oxyethylene groups and high oxyalkylene groups and having an average molecular weight from 600 up to 40,000 and higher. The glycol has utility in a metal quenching liquid.

U.S. pat. No. 2,674,619 discloses condensing ethylene oxide with a polyoxypropylene polymer. The resulting condensate has utility because of its detergent and surface active properties.

SUMMARY OF THE INVENTION

The liquid of present invention is suitable for the formulation of a recycleable metal working liquid. Thus the aforementioned liquids is a concentrate which would be substantially diluted with water for actual use as a metal working liquid. The concentrate comprises a major amount of an aqueous solution of a liquid block copolymer of ethylene oxide and propylene oxide and an effective amount of alkanolamine cinnamate and a boron amine complex to inhibit corrosion. The aforementioned block copolymer has a molecular weight of about 1800–2900. The liquid can also contain a germicide, an anti-foaming agent and an amount of a suitable pH agent sufficient to maintain the pH of the liquid in excess of 7.0.

After use in metal working whereby contamination occurs the liquid upon heating to a temperature range between from about 160° F. to about 210° F. forms two distinct layers. The bottom layer contains most of the active ingredients whereas the upper layer contains most of the contaminants, i.e., the non-metallic dirt, such as oil, colloidal particles and the like. Thus, the bottom layer can be separated, rediluted with water, and reused. Water used in the redilution may contain small of some of the active ingredients lost in the water layer after separation.

Although this liquid can fall into "semi-synthetic" (oil containing) class of chemical coolants, it contains no petroleum oil. Surprisingly, the solution has lubricity or extreme pressure characteristics far superior to commercial semi-snythetics. This superiority is evidenced by tests reported hereinafter.

DESCRIPTION OF THE INVENTION

The concentrate contains water which serves as a solvent for the other components and assists in the subsequent dilution of the concentrate prior to its use. After the concentrate is diluted with water for actual metal working the water serves as a coolant. The amount of water in the concentrate can vary substantially; however, if it is shipped great distances economics favor using the minimum amount necessary. Preferably, about 25 to about 40 parts by volume of water are contained in the liquid concentrate. Preferable concentrations of water in the concentrate are about 30 to about 35. A diluted liquid can be prepared by diluting 1 part of volume of the concentrate with about 5–200 parts by volume of water with about 10–100 parts a preferred range.

A polymer used in the recycleable metal working liquid is a liquid block copolymer of ethylene oxide and propylene oxide. The structure of the polymer can be described as having a central portion of polypropylene oxide with polyethylene oxide on each end. Polypropylene oxide alone is unsatisfactory for this purpose because it is inadequately soluble in water. Polyethylene oxide of the desired molecular weight is a solid at ordinary temperatures and for this reason is unsatisfactory. The block copolymer provides a liquid at ordinary temperatures with sufficient hydrophilic ethylene oxide groups to provide solubility in water. As to its solubility in water, the block copolymer has the property of becoming less soluble in water as the temperature of an aqueous mixture of it increases. And at an elevated temperature the block copolymer can separate out of the water so that two phases exist. Since the block copolymer has a specific gravity greater than one, it is the bottom phase. Generally, the block copolymer is prepared by reacting ethylene oxide with polypropylene oxide. The molecular weight of the copolymer is from 1800 to 2900 with from 2000 to 2400 the preferred range. Generally the copolymer contains from 35 45 weight percent ethylene oxide and from 55 to 65 weight percent polypropylene oxide. The block copolymer serves as a lubricant.

The amount of the block copolymer in the concentrate can vary substantially; however, a preferred range is between from about 40 to 50 parts by volume, a more preferred range is about 42–48 parts by volume. The amount of the copolymer in the diluted liquid can also vary widely; however, a preferred range is between from about 0.2 to about 10 parts by volume. Together the water and liquid block copolymer form an aqueous solution which amounts to a major amount of the concentrate.

The recycleable metal working liquid also contains certain boron compounds, i.e., boron amine complexes. Preparation of these boron complexes is disclosed in Kirk-Othmer, Encyclopedia of Chemical Technology, 2nd Edition, Volume 3, pages 656–657. The boron amime complex serves as a corrosion inhibitor. An example of boron amine is tris(borolane) borazone. The advantage of this corrosion inhibitor is that it does not interfere with the phase separation that the metal working liquid experiences at an elevated temperature. Other examples of boron amine are the reaction complex between methyl borate or phenyl borate and trimethylamine, ammonia, hydrazine and a primary aliphatic amine. Such complexes need to be water soluble. U.S. Pat. No. 2,408,332 discloses a method for making water soluble boron materials.

The amount of the complex in the concentrate is that which is effective to control corrosion during metal working. The preferred amount of complex present in the concentrate is about 5 to about 15 parts by volume; more preferable concentrations are about 7.5 to about 12.5. In the diluted solution about 0.025 to about 3.0 parts by volume can be present.

The concentrate also contains an alkanolamine cinnamate. The amount of the cinnamate present is that which is effective to control corrosion during metal working. The advantage of this corrosion inhibitor is that it does not interfere with the phase separation that the metal working liquid experiences at an elevated temperature. The range of preferred amounts of the cinnamate present in the concentrate is between from about 0.5 to about 4 parts by weight. The range of preferred amounts of the cinnamate present in the diluted solution is between from about 0.0025 to 0.80 parts by weight. The term "parts by weight" means that a gram is used relative to a volume. Thus when 1 part by weight and 50 parts by volume are used it means 1 gram is used along with 50 cubic centameters.

The alkanolamine cinnamate is the reaction product of cinnamic acid and a soluble alkanolamine. Cinnamic acid has the following structure:

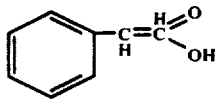

The acid has a cis and trans structure. By itself it serves as a corrosion inhibitor. The acid, however, is insoluble in water. On the other hand, most alkanolamines have infinite solubility in water.

Alkanolamines are amino alcohols; they can be considered as derivatives of ammonia in which at least one hydrogen is replaced by a hydroxyalkyl radical. Generally, alkanolamines are the reaction product of olefin oxides and ammonia. The preparation and properties of alkanolamines are reviewed in Kirk-Othmer, Encyclopedia of Chemical Technology, 2nd Edition, Vol. 1. The first series of alkanolamines are the ethanolamines which include mono-, di-, and triethanolamine $NH_2(C_2H_4OH)$, $NH(_2H_4OH)_2$, $N(C_2H_4OH)_3$, respectively. The cinnamate was the only compound of many tested which permitted a satisfactory two phase mixture to develop at an elevated temperature. The other tried were deficient for various reasons.

While an alkanolamine which is water soluble is a satifactory amine to react with the acid, the ethanolamines are preferred because they are commercially available at a low price. Examples of other suitable water soluble alkanolamines are 2-methylaminoethanol, 2-diethylaminoethanol, 2,2'-(ethylamino)-diethanol, 1-amino-2-propanol and the like.

As indicated heretofore both the boron amine complex and the alkanolamine cinnamate are corrosion inhibitors. However, it seen that the use of both inhibitors together results in better corrosion control than either one by itself.

The metal working liquid also contains an effective amount of a suitable pH control agent. To minimize corrosion of the metal during metal working it is desirable to control the pH of the liquid so that the liquid is basic, i.e., a ph in excess of 7.0. A higher pH minimizes corrosion. Alkanolamines are suitable pH control agents. As to the alkanolamines the ethanolamines are preferred. Alkanolamines have an advantage over other pH control agents because the amines also serve as a corrosion inhibitor. Classes of water soluble comounds which were found not be be suitable control agents were alkali metal hydroxides, such as KOH, and alkali metal carbonates such as $Na_2CO_3$. These unsatisfactoy agents adversely affected the phase separation of the metal working liquid.

The preferred amount of a suitable pH control agent present in the concentrate is about 1–15 parts by volume; a more preferred amount is about 2–12.5. The amount present in the diluted solution can be about 0.0005–3.0 parts.

The metal-working liquid also contains an effective amount of a germicide. A preferred, germicide is a hydrogenated derivative of s-triazine which serves as a germicide. Preparation of s-triazine is disclosed in Kirk-Othmer, Encyclopedia of Chemical Technology, Volume 22, page 183. A hydrogenated derivative os s-triazine which is more preferred is hexahydro-1,3,5-tris(-2hydroxyethyl) s-triazine. It has the following structure:

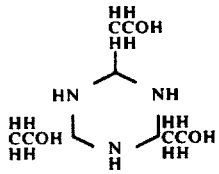

Other effective s-triazines include hexahydro-1,3,5-tris(2-hydroxymethyl) s-triazine, hexahydro-1,3,5-tris(2-hydroxypropyl) s-triazine, and hexahydro-1,3,5-tris(2-hydroxybutyl) s-triazine.

The germicide in the concentrate can be present in about 0.4 to about 1.5 parts by volume; preferable concentrations are about 0.06 to about 1.25. The diluted solution can contain about 0.002 to about 0.30 parts by volume.

Also contained in the metal working liquid is an effective amount of antifoaming agent. One example of a class of suitable defoamers is silicone emulsions. The amount of the defoamer in the concentrate is about 500 ppm to about 1500 ppm parts by volume, whereas in the diluted solution it would be present in about 3 ppm to about 300 ppm.

The color of the metal working liquid concentrate is pale yellow and has practically no odor. Upon dilution with water the solution has a bright clear appearance.

The advantage of a concentrate compared to a dilute solution is that the shipping cost is lower because a large volume of water is not transported. The concentrate can also be prepared at one central location which minimizes investment requirements. Both of these advantages are important in view of our current inflation problem.

At the point of use the concentrate is diluted with clean water so that the diluted concentration heretofore mentioned is obtained. In use the metal working fluid is juxtaposed to contacting surfaces and while in use, the liquid is generally a solution. As a solution, no separation occurs. The liquid in use carries away heat formed during the metal working operation, provides lubrication and protect the finish and inhibits corrosion. The liquid also carries away any oil on the metal part, metal cuttings caused by the metal working operation and in the case of grinding, the particulars of the grinding tool that break away.

After substantial use the liquid becomes contaminated and if it was a conventional soluble cutting liquid it would be discarded and require substantial chemical treatment prior to final disposal. However, the liquid can be heated to a temperature of between about 160° F, preferably about 170° F to about 200° F and upon reaching such a temperature the liquid forms two distinct layers. Advantageously, the lower layer is mostly water with some traces of the active materials. Furthermore, advantageously none of the aforementioned materials interfere with the phase separation. Much of the dirt is also found in the water layer. After separation of the two layers any heavier dirt in the bottom layer can be also removed by decantation or filtration. The water layer can be discarded. To the separated bottom layer water can be added to obtain the desired concentration for actual use. The added water can also contain sufficient amounts of active materials to make up those contained in the discarded water layer. Generally very little copolymer is contained in the discarded water so only the other materials need be added to the makeup water.

The foregoing water layer, upon being discarded, requires a minimum of or not subsequent chemical treatment. The water layer is relatively pure compared to the water separated from a conventional cutting liquid and requires little further treatment before disposal in a sewer system. In contrast the water separated from a conventional cutting liquid normally would contain almost all of the chemicals used to break the mixture.

The detailed practice of the invention is illustrated by the following example.

EXAMPLE

A concentrate was prepared containing 33% by volume water, 45% by volume of a liquid block copolymer obtained by the reaction of ethylene oxide with polypropylene oxide and having a molecular weight of about 2200, and containing about 40 weight percent of ethylene oxide and 60 percent of propylene oxide, 1 part by volume of hexahydro-1,3,5tris(2-hydroxyethyl)s-triazine, 1 part by weight of cinnamic acid, 10 parts by volume of tris-(boralone)borazole, 10 parts by volume of triethanolamine, and 0.1% by volume of a silicone emulsion.

In the aforementioned concentrate the triethanolamine reacts with the cinnamic acid to form triethanolamine cinnamate. Also, the amount of amine used is such that after the formation of the cinnamate sufficient amine remains unreacted so as to provide effective pH control and assist in corrosion control.

The foregoing materials generally can be added together in any sequence. After combining the materials at room temperature, some shaking or stirring insures that a solution is obtained.

The color of the concentrate was pale yellow and it had practically no odor.

To test the aforementioned concentrate for extreme pressure properties the following procedure was used. 0.5 parts of the foregoing concentrate was diluted with 99.5 parts of tap water. The reason for the extreme dilution is to insure fail results in a reasonable amount of time; it is an accepted means of testing. The resulting dilution had a bright clear appearance. This diluted solution was tested as to its film strength on a Falex apparatus with a one minutes step up (OMSU). The apparatus places an increasing amount of pressure on a steel pin revolving between two "VEE" blocks. Failure occurs when the pin welds to the jaws or breaks. The result is reported as pounds of pressure at failure. The diluted solution failed at 3500 pounds jaw load which was a rather high value compared to a similar oil containing liquid which failed at 1750 pounds.

The diluted solution was heated to a temperature of about 190° F. and upon that temperature two phases were formed. The upper hase contained mostly water whereas the bottom phase contained the active materials. The bottom phase contained almost all of the copolymer and about 80–90% of the remaining active materials. Separation of the two phases was easily obtained via decantation.

Surprisingly, when the amount of the block copolymer contained in the diluted solution fell below about 2.5% the blend became hazy and upon heating a very poor separation took place. foregoing recycleable metal working fluid but they destroyed the blend's ability to be thermally recycled. These other materials are those normally considered to be good corrosion inhibitors or contributing to lubricity of pH agents. Among these were potassium hydroxide, adducts of oleic acid and ethylene oxide, sodium and potassium oleates, ethoxylated diamines, ethoxylated resins acids, dimer acids, ethoxylated elaidic acid, piperidine, potassium and sodium nitrites, sodium benzoate and sodium carbonate.

Equivalent results to the foregoing will be obtained with the use of other materials, for example, such as the use of s-triazines such as hexahydro-1,3,5-tris(2-hydroxy-methyl) s-triazine, hexahydro-1,3,5-tris(2-hydroxybutyl) s-triazine and alkanolamines such as monoethanol amine, diethanol amine, 2-methylaminoethanol, 2-diethylaminoethanol, 2,2-(ethylimino)diethethanol, 1-amino-2-propanol.

Furthermore none of the foregoing components contain any ingredients which would adversely affect the recycleable nature of the metal working liquid.

The invention claimed is:

1. A liquid suitable for the formulation of a recycleable metal working liquid comprising a major amount of an aqueous solution of a liquid block copolymer of ethylene oxide and propylene oxide, said copolymer having a molecular weight of about 1800–2900, and an amount of both an alkanolamine cinnamate and a boron amine complex effective to inhibit corrosion and which complex is the reaction complex between methyl borate or phenyl borate and one of the following: trimethylamine, ammonia, hydrazine and primary aliphatic hydrocarbyl amine.

2. Liquid according to claim 1 wherein the alkanolamine is an ethanolamine.

3. Liquid according to claim 1 containing an amount of hydrogenated s-triazine derivative sufficient to serve as a germicide.

4. Liquid according to claim 3 containing an amouont of silicone emulsion sufficient to serve as an anti-foaming agent.

5. Liquid according to claim 4 containing an amount of alkanolamine sufficient to pH of the liquid at an excess of 7.0.

6. Liquid according to claim 5 wherein the germicide is a hydrogenated derivative of s-triazine selected from the group consisting of hexahydro-1,3,5-tris(2-hydroxyethyl) s-triazine,
hexahydro-1,3,5-tris(2-hydroxymethyl) s-triazine,
hexahydro-1,3,5-tris(2-hydropropyl) s-triazine, and
hexahydro-1,3,5-tris(2-hydroxybutyl s-triazine.

7. Liquid according to claim 5 wherein the alkanolamine is an ethanolamine.

8. Liquid according to claim 6 wherein the germicide is a hydrogenated derivative of s-triazine selected from the group consisting of hexahydro-1,3,5-tris(2-hydroxyethyl) s-triazine,
hexahydro-1,3,5-tris(2-hydroxymethyl) s-triazine,
hexahydro-1,3,5-tris(2-hydropropyl) s-triazine, and
hexahydro-1,3,5-tris(2-hydroxybutyl) s-triazine;

and is present in an amount of about 9.4–1.5 parts by volume; the silicone emulsion is present in an amount of about 500–1500 ppm parts by volume; the alkanolamine is present in an amount of about 1–15 parts by volume; the boron amine corrosion inhibitor is present in an amount of about 5–15 parts by volume; the block copolymer is present in an amount of about 40–50 parts by volume; the water is present in an amount of about 25–40 parts by volume; and the alkanolamine cinnamate is present in an amount of about 0.5–4 parts by weight.

9. Liquid according to claim 8 wherein the copolymer contains about 35–45 weight percent ethylene oxide and about 55–65 weight percent propylene oxide.

10. Liquid according to claim 9 wherein the alkanolamine is an ethanolamine.

11. Liquid according to claim 10 wherein the ethanolamine is triethanolamine.

12. In a method for metal working wherein relatively small amounts of metal are removed from an article and a metal working fluid is juxtaposed to contacting surfaces, the improvement comprises that the liquid comprises a major amount of an aqueous solution of a liquid block copolymer of ethylene oxide and propylene oxide, said copolymer having a molecular weight of about 1800–2900 and an effective amount of both an alkanolamine cinnamate and a boron amine complex to inhibit corrosion and which complex is the reaction complex between methyl borate or phenyl borate and one of the following: trimethylamine, ammonia, hydrazine and primary aliphatic hydrocarbyl amine.

13. Improvement according to claim 12 wherein the liquid contains an amount of hydrogenated s-triazine derivative sufficient to serve as a germicide and an amount of silicone emulsion sufficient to serve as an anti foaming agent and an amount of alkanolamine sufficient to maintain the liquid's pH in excess of 7.0.

14. Improvement according to claim 13 wherein the germicide is a hydrogenated derivative of s-triazine selected from the group consisting of hexahydro-1,3,5-tris(2-hydroxyethyl) s-triazine,
hexahydro-1,3,5-tris(2-hydroxymethyl) s-triazine,
hexahydro-1,3,5-tris(2-hydropropyl s-trizaine, and
hexahydro-1,3,5-tris(2-hydroxybutyl) s-triazine.

15. Liquid according to claim 1 wherein the boron amine complex is tris(borolane) borazone.

16. Improvement according to claim 12 wherein the boron amine complex is tris (borolane) borazone.

17. In a method for metal working wherein relatively small amounts of metal are removed from an article and a metal working liquid is juxtaposed to contacting surfaces, the improvement comprises that the liquid comprises a major amount of an aqueous solution of a liquid block copolymer of ethylene oxide and propylene oxide, said copolymer having a molecular weight of about 1800–2900 and an effective amount of both an alkanolamine cinnamate and a boron amine complex to inhibit corrosion and which complex is the reaction complex between methyl borate or phenyl borate and one of the following: trimethylamine, ammonia, hydrazine or primary aliphatic hydrocarbyl amine and afterwards the liquid is heated to an elevated temperature and phase separation occurs and resulting layers are separated.

18. Improvement according to claim 17 wherein the liquid contains an amount of hydrogenated s-triazine derivative sufficient to serve as a germicide and an amount of silicone emulsion sufficient to serve as an anti-foaming agent and an amount of alkanolamine sufficient to maintain the liquid's pH in excess of 7.0.

19. In a method for metal working wherein relatively small amounts of metal are removed from an article and a metal working liquid is juxtaposed to contacting surfaces, the improvement comprises that the liquid comprises a major amount of an aqueous solution of a liquid block copolymer of ethylene oxide and propylene oxide, said copolymer having a molecular weight of about 1800–2900 and an effective amount of both an alkanolamine cinnamate and a boron amine complex to inhibit corrosion and which complex is the reaction complex between methyl borate or phenyl borate and one of the following: trimethylamine, ammonia, hydrazine or primary aliphatic hydrocarbyl amine and afterwards the liquid is heated to an elevated temperature and phase separation occurs and resulting layers are separated and a contaminated water layer is discarded and remaining mixture is rediluted with water containing the materials discarded with the contaminated water layer.

20. Improvement according to claim 19 wherein the liquid contains an amount of hydrogenated s-triazine derivative sufficient to serve as a germicide and an amount of slicone emulsion sufficient to serve as an anti-foaming agent and an amount of alkanolamine sufficient to maintain the liquid's pH in excess of 7.0.

21. Improvement according to claim 12 wherein the elevated temperature is about 160°–210° F.

22. Improvement according to claim 17 wherein the elevated temperature is about 160°–210° F.

23. Improvement according to claim 19 wherein the elevated temperature is about 160°–210° F.

* * * * *